US010359198B2

(12) United States Patent
Jeong et al.

(10) Patent No.: US 10,359,198 B2
(45) Date of Patent: Jul. 23, 2019

(54) GAS OVEN RANGE

(71) Applicant: LG ELECTRONICS INC., Seoul (KR)

(72) Inventors: Jeonghoon Jeong, Seoul (KR); Ingyu Yang, Seoul (KR); Youngsoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 272 days.

(21) Appl. No.: 15/274,680

(22) Filed: Sep. 23, 2016

(65) Prior Publication Data

US 2017/0089585 A1 Mar. 30, 2017

(30) Foreign Application Priority Data

Sep. 25, 2015 (KR) ..... 10-2015-0136680

(51) Int. Cl.

| | |
|---|---|
| ***F24C 3/08*** | (2006.01) |
| ***F24C 3/10*** | (2006.01) |
| ***F23D 14/10*** | (2006.01) |
| ***F24C 15/00*** | (2006.01) |
| ***F24C 15/32*** | (2006.01) |

(52) U.S. Cl.

CPC ..... *F24C 3/103* (2013.01); *F23D 14/10* (2013.01); *F24C 15/007* (2013.01); *F24C 3/087* (2013.01); *F24C 15/322* (2013.01)

(58) Field of Classification Search

CPC ..... F24C 3/103; F24C 3/087; F24C 15/322; F24C 15/007; F23D 14/10

USPC ..... 126/39 B

See application file for complete search history.

(56) References Cited

U.S. PATENT DOCUMENTS

| | | | | |
|---|---|---|---|---|
| 4,671,250 | A | 6/1987 | Hurley et al. | |
| 4,813,398 | A | 3/1989 | Savage | |
| 5,275,555 | A * | 1/1994 | Goodridge | F23D 14/085 126/39 E |
| 5,298,336 | A * | 3/1994 | Tanaka | B32B 15/015 419/28 |
| 5,407,161 | A * | 4/1995 | Mulkeran | F28F 9/002 165/67 |
| 6,371,104 | B1 | 4/2002 | Voohris | |
| 2010/0003626 | A1 | 1/2010 | Schlosser | |
| 2016/0209027 | A1 | 7/2016 | Yoon | |
| 2016/0320066 | A1 | 11/2016 | Lee et al. | |

FOREIGN PATENT DOCUMENTS

| | | | |
|---|---|---|---|
| JP | 2015-51066 | A | 3/2015 |
| KR | 20-1998-0008902 | U | 4/1998 |
| KR | 10-1299921 | B1 | 8/2013 |
| KR | 10-2014-0067749 | A | 6/2014 |

* cited by examiner

*Primary Examiner* — Steven B McAllister
*Assistant Examiner* — Allen R Schult
(74) *Attorney, Agent, or Firm* — Dentons US LLP

(57) ABSTRACT

A gas oven range that includes a burner fixed to a support plate provided on a rear wall of a cavity forming an oven chamber, a fixing bracket fixed to a part of the burner, a medium bracket connected to the fixing bracket in the forward and backward directions of the cavity so as to be hook-combined with one point of the fixing bracket and be screw-combined with another point of the fixing bracket, and an igniter detachably combined with the fixing bracket by the medium bracket and fastened with the medium bracket in the leftward and rightward directions of the cavity.

13 Claims, 7 Drawing Sheets

GAS OVEN RANGE

CROSS-REFERENCE TO RELATED APPLICATION

This application claims priority under 35 U.S.C. § 119 to Korean Patent Application No. 10-2015-0136680, filed on Sep. 25, 2015, the disclosure of which is incorporated herein by reference.

BACKGROUND OF THE INVENTION

1. Field of the Invention

A gas oven range and, more particularly, to a gas oven range in which a burner and an igniter may be easily assembled and the igniter may be easily replaced so as to reduce an assembly time and a replacement time.

2. Description of the Related Art

In general, a gas oven range is a cooking apparatus which heats or cooks food using gas. The gas oven range conventionally includes an oven chamber in which food is cooked, a burner to combust gas to cook the food in the oven chamber, and an igniter provided in a combustion chamber for initial ignition of gas combustion in the burner.

However, in such a conventional gas oven range, if the igniter dies or malfunctions and needs to be replaced or repaired, the entire burner must be separated from the gas oven rage, which takes a long time.

SUMMARY OF THE INVENTION

An object of the present invention is to provide a gas oven range in which assembly and separation of a burner and an igniter in a cavity is easily carried out so as to reduce an assembly time and a replacement time relative to conventional gas oven ranges.

The objects of the present invention are not limited to the above-mentioned objects and other objects that have not been mentioned above will become evident to those skilled in the art from the following description.

To achieve the above objects, there is provided a gas oven range according to an embodiment of the present invention, including a burner fixed to a support plate provided on a rear wall of a cavity forming an oven chamber, a fixing bracket fixed to a part of the burner, a medium bracket connected to the fixing bracket in the forward and backward directions of the cavity, and an igniter detachably combined with the fixing bracket by the medium bracket.

The medium bracket may be hook-combined with one point of the fixing bracket and be then screw-combined with another point of the fixing bracket.

The fixing bracket may include a welding combination part fixed to the part of the burner by welding and a screw fastening plate formed integrally with one side of the welding combination part so as to be bent and screw-combined with the support plate by a main screw fastened to the support plate in the forward and backward directions, and the medium bracket may be combined with the screw fastening plate of the fixing bracket by the main screw.

A first protrusion to fix the medium bracket and a first main screw hole to pass the main screw therethrough may be formed on the screw fastening plate.

The first main screw hole may be formed through the screw fastening plate in the forward and backward directions.

The first protrusion may be formed at any one of the upper and lower ends of the screw fastening plate, and the first main screw hole may be formed at the end of the screw fastening plate opposite the position of the first protrusion.

The first protrusion may have a shape which protrudes and extends forward from any one of the upper and lower ends of the screw fastening plate and is bent perpendicularly upward or downward.

A first hole, formed at a position of the medium bracket corresponding to the first protrusion so that the first handing protrusion is inserted into the first hole, and a second main screw hole, formed at a position of the medium bracket corresponding to the first main screw hole so that the main screw passes through the second main screw hole, may be formed on the medium bracket.

The medium bracket may include a first fixing plate being in surface contact with the screw fastening plate, a second fixing plate bent forward from the first fixing plate and extending so that the igniter is combined with the second fixing plate, and a third fixing plate bent leftward or rightward from the second fixing plate so as to support the rear surface of the igniter.

The medium bracket may be hook-combined with one point of the igniter and be screw-combined with another point of the igniter.

The medium bracket may further include a second protrusion for hook-combination with the igniter at one point, formed on the second fixing plate, and a first sub-screw hole for screw-combination with the igniter at another point, formed on the second fixing plate.

The second protrusion may be formed at any one of the upper and lower ends of the second fastening plate, and the first sub-screw hole may be formed at the end of the second fastening plate opposite the position of the second protrusion.

The second protrusion may have a shape which protrudes and extends forward from any one of the upper and lower ends of the second fastening plate and is bent perpendicularly upward or downward.

The igniter may further include an igniter case combined with the second fixing plate of the medium bracket, and a second hole, formed at a position corresponding to the second protrusion so that the second protrusion is inserted into the second hole, and a second sub-screw hole to pass a sub-screw therethrough may be formed on the igniter case.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

The advantages and features of the present invention, and the way of attaining the same, will become apparent with reference to embodiments described below in conjunction with the accompanying drawings. Reference will now be made in detail to the preferred embodiments of the present invention, examples of which are illustrated in the accompanying drawings. Wherever possible, the same reference numbers will be used throughout the drawings to refer to the same or like parts.

Figure 1:
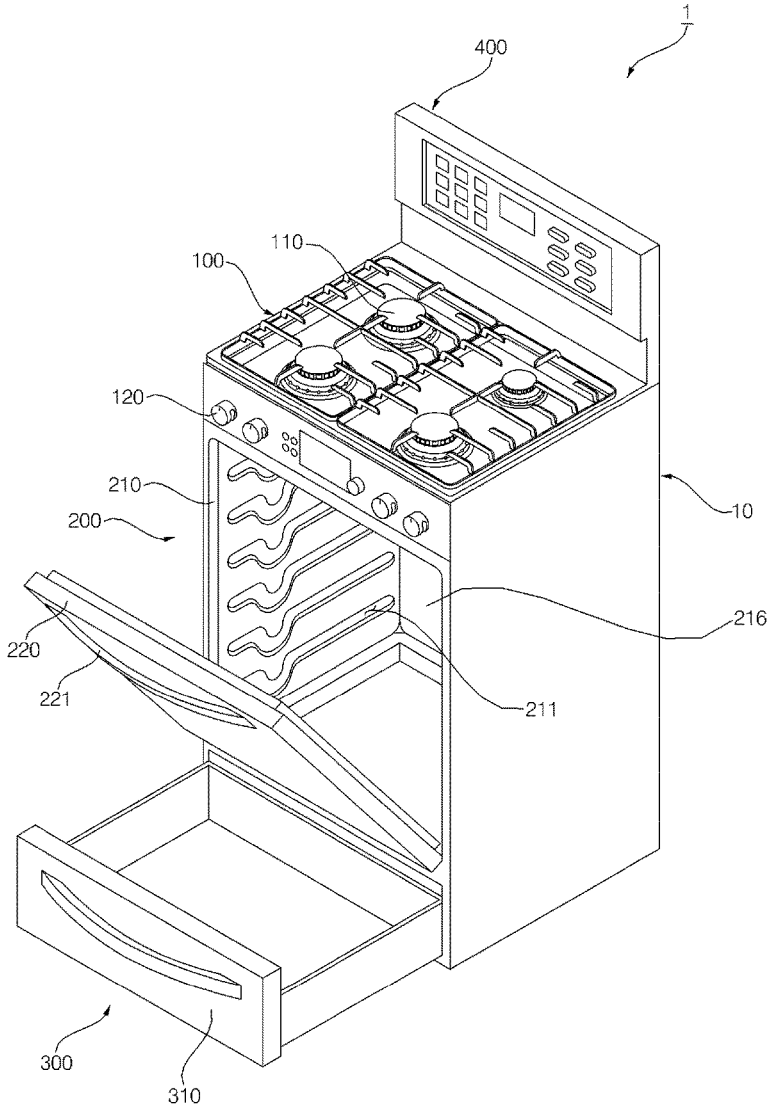
FIG. 1 is a perspective view illustrating a gas oven range in accordance with an embodiment of the invention in a state in which a cavity is opened.
Figure 2:
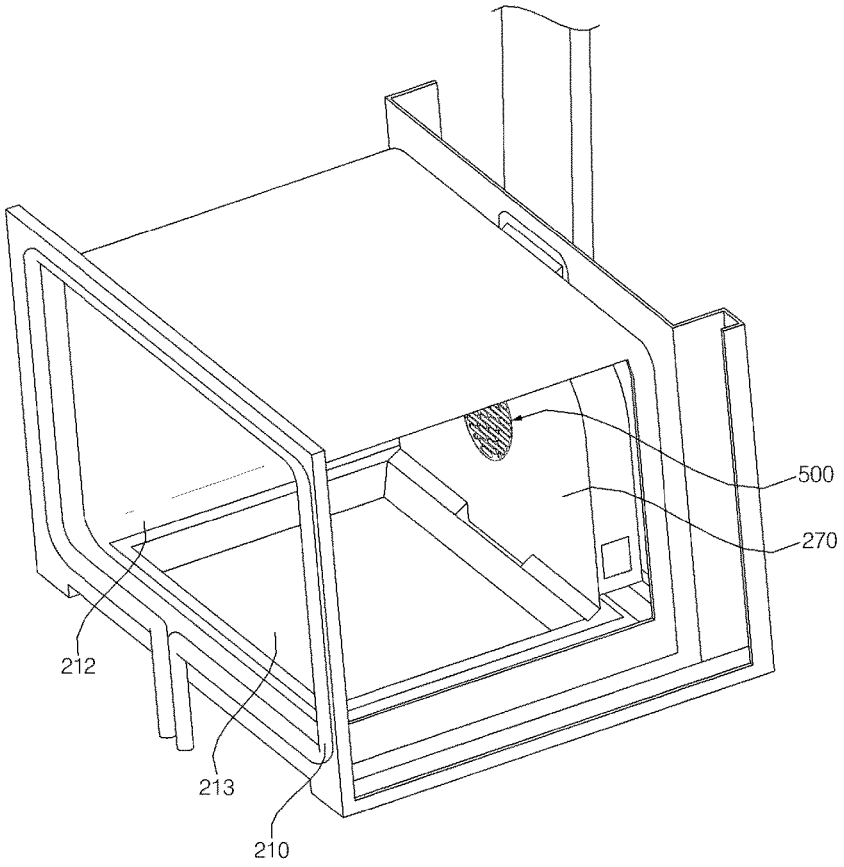
FIG. 2 is a perspective view illustrating an oven unit of the gas oven range in accordance with an embodiment of the invention.

FIG. 1 is a perspective view illustrating a gas oven range in accordance with an embodiment of the invention in a state in which a cavity is opened, and FIG. 2 is a perspective view illustrating an oven unit of the gas oven range in accordance with an embodiment of the invention.

As shown in FIG. 1, the gas oven range 1 includes a main body 10. The main body 10 may include a cooktop unit 100, an oven unit 200, a drawer unit 300, and a controller 400. It is understood, however, that the cooktop unit 100 and the drawer unit 300 may be omitted. Also, it is understood that the gas oven range 1 may include one oven unit 200 or a plurality of oven units 200.

The cooktop unit 100, the oven unit 200, and the drawer unit 300 may be respectively provided at upper, middle, and lower portions of the main body 10. The controller 400 may be provided at the rear end of the upper surface of the main body 10.

The cooktop unit 100 may include a plurality of cooktop burners 110. The cooktop burners 110 function to directly heat containers (e.g., pots and pans) filled with food using a flame generated by combusting gas, thus cooking the food. A plurality of controls or knobs 120 may be provided at the front end of the cooktop unit 100. The controls or knobs 120 may be used to adjust opening/closing or opening degrees of valves (not shown) which adjust whether or not gas is supplied or gas supply amounts.

The oven unit 200 is provided with a cavity 210 forming an oven chamber 211 in which food is cooked. The cavity 210 has an opened front surface and is thus formed by both side walls, an upper wall, a rear wall and a bottom wall.

The oven unit 200 includes an oven door 220 to open and close the oven chamber 211. The oven door 220 may be rotatably connected to the main body 10. For example, in a non-limiting example, the oven door 220 may open and close the oven chamber 211 through a pull-down method in which the upper end of the oven door 220 is vertically rotated toward the front about the lower end of the oven door 220.

A door handle 221 manipulated by a user hand to rotate the oven door 220 may be formed at the upper end of the front surface of the oven door 220.

The drawer unit 300 may serve to keep a container filled with food, etc. warm at a designated temperature, and may include a drawer 310 inside thereof to receive the container.

The controller 400 receives an operation signal to operate the gas oven range 1, more particularly, an operation signal to operate at least one of the cooktop unit 100, the oven unit 200 and the drawer unit 300. The controller 400 may display various types of information regarding operation of the gas oven range 1 in accordance with the present invention.

FIG. 2 shows an exemplary embodiment of a heating unit 500 to cook food in the oven chamber 211 being disposed at the rear wall 216 of the cavity 210.

Figure 3:
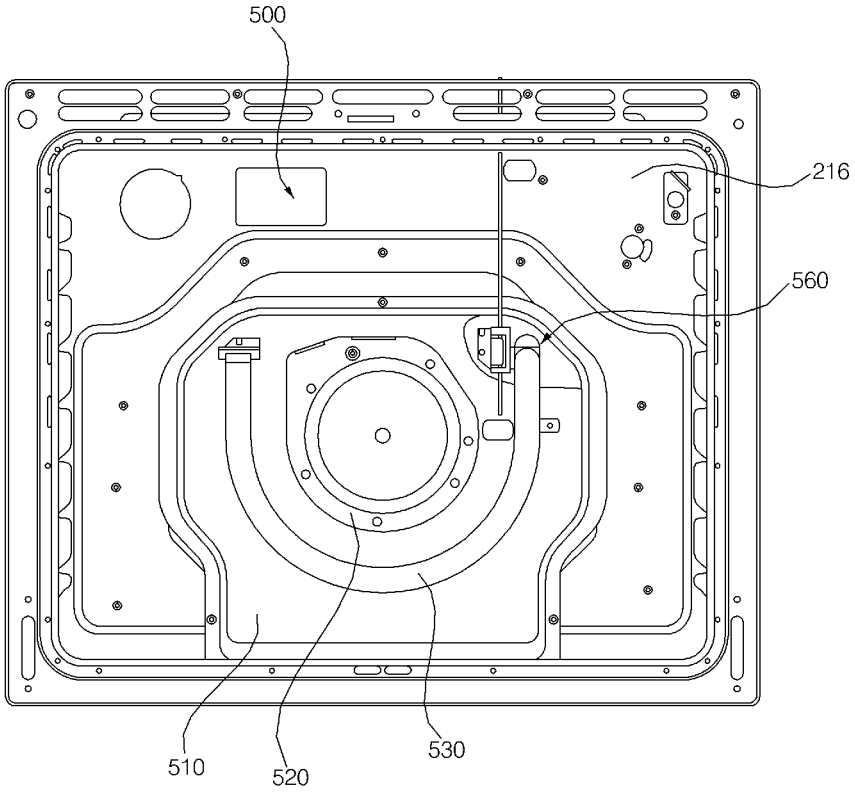
FIG. 3 is a front view illustrating a rear wall, with which a burner is assembled, in the configuration in accordance with an embodiment of the invention.
Figure 4:
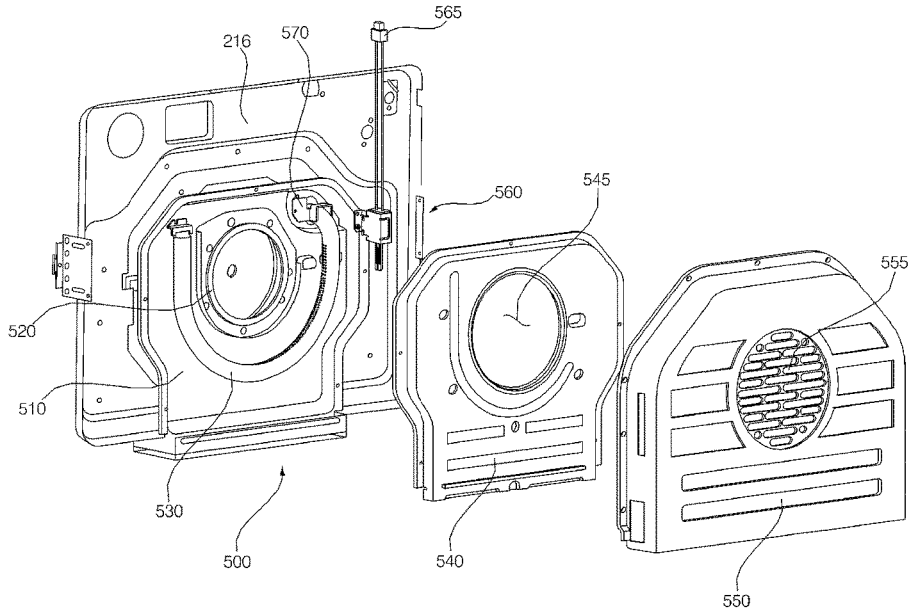
FIG. 4 is an exploded perspective view of FIG. 3.
Figure 5:
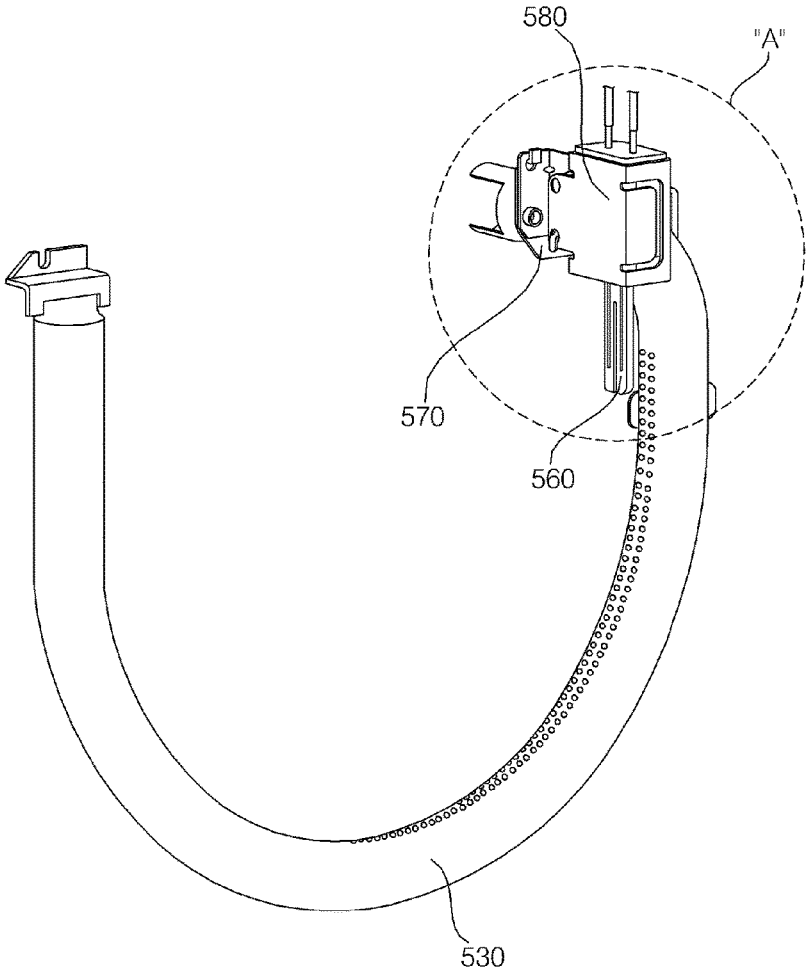
FIG. 5 is a perspective view illustrating coupling of an igniter with the burner in the configuration of FIG. 3.
Figure 6:
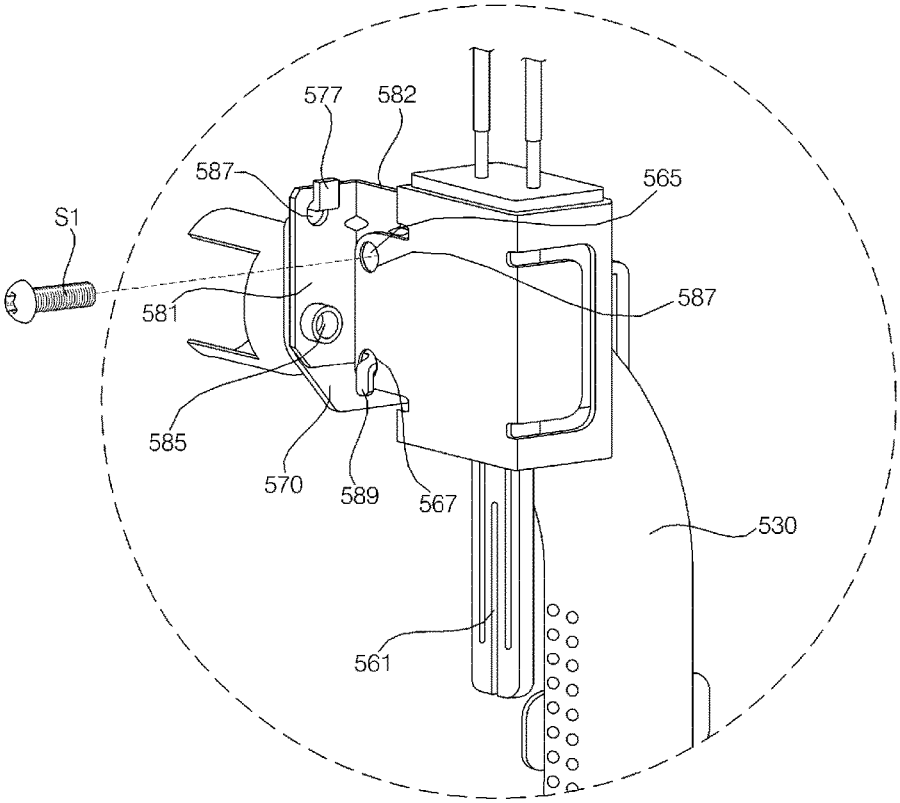
FIG. 6 is an enlarged perspective view of portion "A" of FIG. 5.
Figure 7:
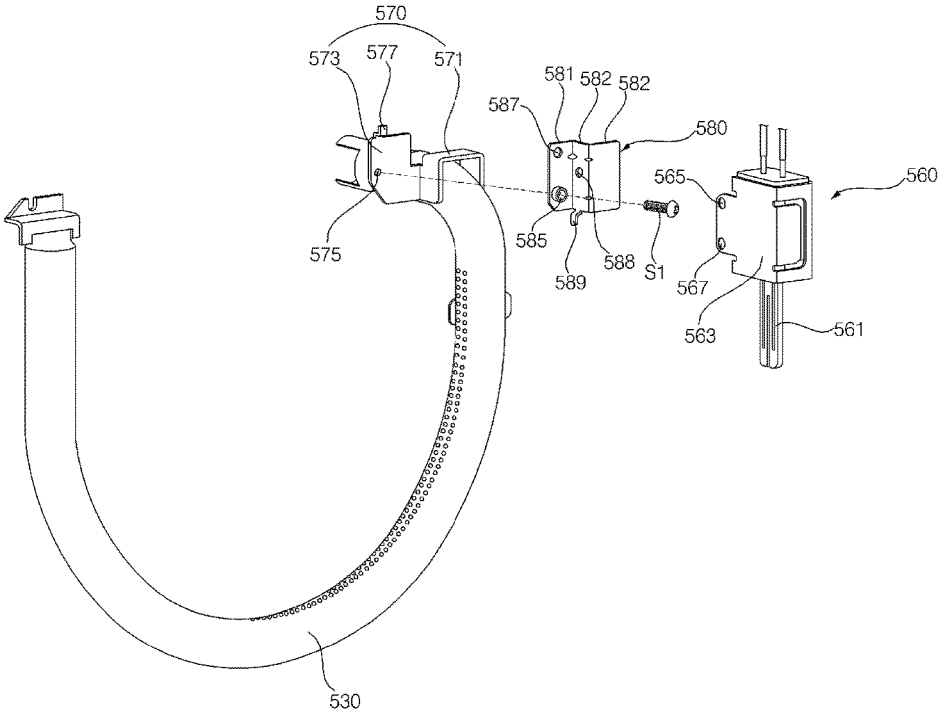
FIG. 7 is an exploded perspective view of FIG. 5.

FIG. 3 is a front view illustrating a rear wall, with which the burner is assembled, in the configuration in accordance with an embodiment of the invention, FIG. 4 is an exploded perspective view of FIG. 3, FIG. 5 is a perspective view illustrating coupling of the igniter with the burner in the configuration of FIG. 3, FIG. 6 is an enlarged perspective view of portion "A" of FIG. 5, and FIG. 7 is an exploded perspective view of FIG. 5.

As shown, the heating unit 500 includes a burner assembly 505 to heat food. The burner assembly 505 may be fixed to a support plate 510 provided at the rear wall 216 of the cavity 210 forming the oven chamber 211.

A burner 530 is ignited by an igniter 560, which will be described later, and thus generates a flame while discharging introduced gas.

As shown in FIG. 4, the burner 530may be electrically connected to a machine room by a connection terminal 565 and thus ignition of the burner 530 may be controlled by the controller 400.

The burner assembly 505 may include a fan (not shown) to blow air heated by a flame in the oven chamber 211, a fan plate 520 on which the fan is installed, a burner cover 540 to cover the burner 530, and a fan cover 550 to cover the fan.

A combustion space for combustion of gas may be formed between the support plate 510 and the burner cover 540. The fan may be installed at a central portion of the support plate 510. A fan hole 545 through which the fan passes may be formed at the central portion of the burner cover 545. A discharge grill 555 through which heated air in the combustion space is discharged by the fan may be formed at the central portion of the fan cover 550.

A plurality of flame holes (denoted by no reference numeral, with reference to FIG. 5) to discharge gas are formed through the burner 530. The burner 530 may be formed in an approximately "U" shape so as to increase a flame generation area and may be fixed to the support plate 510.

Fixing brackets 570 may be combined with both upper ends of the "U"-shaped burner 530 in order to fix the burner 530 to the support plate 510. Any one of both upper ends of the burner 530 may be bent so as to pass through the rear wall 216 for connection with a gas supply unit, which is not shown. The fixing brackets 570 may be welded to the support plate 510. As exemplarily shown in FIGS. 5 and 6, the upper end of a right side of the burner 530 may be bent so as to pass through the rear wall 216 for connection with the gas supply unit.

The space formed by the support plate 510 and the burner cover 540 covering the burner 530 is a combustion space in which a flame is generated, and the igniter 560 is combined with such a space.

Hereinafter, an assembly structure between the burner 530 and the igniter 560 will be described in detail.

With reference to FIG. 5, the igniter 560 may be detachably combined with the fixing bracket 570 fixed to a part of the burner 530 by a medium bracket 580.

The fixing bracket 570, with reference to FIGS. 6 and 7, may include a welding combination part 571 fixed to a part of the burner 530 by welding, and a screw fastening plate 573 formed integrally with one side of the welding combination part 571. The screw fastening plate 573 may be bent away from the welding combustion part 571 and screw-combined with the support plate 510 by a main screw S1 fastened to the support plate 510 in the forward and backward directions.

Here, the welding combination part 571 may be formed to have a C-shaped cross-section so as to cover at least part of the upper end of the right side of the burner 530 bent to approximately pass through the rear wall 216, but is not limited to such shape.

The screw fastening plate 573 may be vertically disposed such that the front surface of the screw fastening plate 573 may be seen by a user if it is observed at the opened front of the cavity 210.

The medium bracket 580 may be hook-combined with the fixing bracket 570 at one point and screw-combined with the fixing bracket 570 at another point. As shown in FIG. 7, the medium bracket 580 may be fastened to the fixing bracket 570 in the forward and backward directions of the cavity.

The igniter 560 may be detachably combined with the fixing bracket 570 by the medium bracket 580, and fastened to the medium bracket 580 in the leftward and rightward directions of the cavity 210.

As shown, the medium bracket 580 may be combined with the screw fastening plate 573 of the fixing bracket 570 by the main screw S1.

A first protrusion 577, inserted into the medium bracket 580, and a first main screw hole 575, through which the main screw S1 passes, may be formed on the screw fastening plate 573.

More particularly, the first main screw hole 575 may be formed through the screw fastening plate 573 in the forward and backward directions, and the first protrusion 577 may be formed at the upper end or the lower end of the screw fastening plate 573.

Preferably, if the first main screw hole 575 is formed at the upper end of the screw fastening plate 573, the first protrusion 577 may be formed at the lower end of the screw fastening plate 573 and, if the first main screw hole 575 is formed at the lower end of the screw fastening plate 573, the first protrusion 577 may be formed at the upper end of the screw fastening plate 573. In other words, preferably, the first main screw hole 575 and the first protrusion 577 are formed at opposite ends of the screw fastening plate 573.

For example, if the first protrusion 577 is formed at the upper end of the screw fastening plate 573, then the first protrusion 577 may have a shape which protrudes and extends forward and is bent perpendicularly upward. Likewise, if the first protrusion 577 is formed at the lower end of the screw fastening plate 573, then the first protrusion 577 may have a shape which protrudes and extends forward and is bent perpendicularly downward. Hereinafter, the first protrusion 577 formed at the upper end of the screw fastening plate 573 will be exemplarily described.

One point of the medium bracket 580 is hook-combined with the first protrusion 577 of the screw fastening plate 573, and the above-described main screw S1 is fastened to a second main screw hole 585 formed through the medium bracket 580, which will be described later, and the above-described first main screw hole 575, thereby securely fixing the medium bracket 580 to the fixing bracket 570.

A first hole 587, into which the first protrusion 577 is inserted, may be formed at a position of the medium bracket 580 corresponding to the first protrusion 577.

Further, the second main screw hole 585, which is located at a position corresponding to the first main screw hole 575 so that the main screw S1 passes through the second main screw hole 585, may be formed at a region of the medium bracket 580 that is in surface contact with the front surface of the screw fastening plate 573 when the medium bracket 580 is combined with the fixing bracket 570.

The first protrusion 577 passes through the first hole 587, in a state in which the lower end of the medium bracket 580 is inclined slightly downward in the forward direction. The first protrusion is then hooked into the first hole 587 and the rear surface of a first fixing plate 581 of the medium bracket 580, which will be described later, is closely adhered to the front surface of the screw fixing plate 573 so that the first main screw hole 575 and the second main screw hole 585 match each other.

As will be described later, the gas oven range in accordance with one embodiment of the invention is advantageous in that the igniter 560 may be separated from the burner 530 by a single motion of releasing the main screw S1 from the first main screw hole 575 and the second main screw hole 585 in the modularized state of the igniter 560 and the medium bracket 580. Similarly, the igniter 560 may be assembled with the burner 530 by a motion of fastening the main screw S1 into the first main screw hole 575 and the second main screw hole 585 in the modularized state of the igniter 560 and the medium bracket 580.

The medium bracket 580 may include the first fixing plate 581 that is in surface contact with the screw fastening plate 573 of the fixing bracket 570, a second fixing plate 582 that may be bent forward from the first fixing plate 581 and extending so that the igniter 560 is connected to the second fixing plate 582, and a third fixing plate 583 that may be bent leftward or rightward from the second fixing plate 582 so as to support the rear surface of the igniter 560.

The medium bracket 580 may be hook-combined with the igniter 560 at one point and screw-combined with the igniter 560 at another point.

More particularly, a second protrusion 589 for hook-combination with the igniter 560 at one point may be formed on the medium bracket 580, particularly, the second fixing plate 582, and a first sub-screw hole 588 for screw-combination with the igniter 560 at another point may be formed on the second fixing plate 582.

The second protrusion 589 may be formed at the lower end of the second fixing plate 582 if the first sub-screw hole 588 is formed at the upper end of the second fixing plate 582. Similarly, the second protrusion 589 may be formed at the upper end of the second fixing plate 582 if the first sub-screw hole 588 is formed at the lower end of the second fixing plate 582. In other words, preferably, the second protrusion 589 and the first sub-screw hole 588 are formed at opposite ends of the second fixing plate 582.

For example, if the second protrusion 589 is formed at the upper end of the second fastening plate 582, the second protrusion 589 may have a shape which protrudes and extends forward and is bent perpendicularly upward. Similarly, if the second protrusion 589 is formed at the lower end of the second fastening plate 582, the second protrusion 589 may have a shape which protrudes and extends forward and is bent perpendicularly downward. Hereinafter, the second protrusion 589 formed at the lower end of the second fastening plate 582 will be exemplarily described.

The igniter 560 may further include an igniter case 563 combined with the second fixing plate 582 of the medium bracket 580. The igniter case 563 may surround the igniter 560 so as to protect the igniter 560, and mediate combination with the medium bracket 580.

A second hole 567, which may be formed at a position corresponding to the second protrusion 589 so that the second protrusion 589 is inserted into the second hole 567, and a second sub-screw hole 565, through which a sub-screw S2 passes, may be formed on the igniter case 563.

The medium bracket 580 may be disposed such that one surface and the other surface of the second fixing plate 582 face leftward and rightward in the cavity, and the above-described second hole 567 and second sub-screw hole 565 are formed at a region of the igniter case 563 that extends backward to a designated length so as to be in surface contact with the second fixing plate 582 in front of the medium bracket 580.

Further, the above-described second protrusion 589 may be formed at the lower end of the second fixing plate 582 of the medium bracket 580 and the above-described first sub-screw hole 588 may be formed through the second fixing plate 582.

The medium bracket 580 in the separated state from the fixing bracket 570 may be combined with the igniter case 563.

The second protrusion 589 of the medium bracket 580 may be hooked into the second hole 567 of the igniter case 562 in a state in which the medium bracket 580 is inclined slightly upward in the leftward or rightward direction, and one surface of the second fixing plate 582 of the medium bracket 580 is closely adhered to the rear extending region of the igniter case 563 so that the first sub-screw hole 588 of the medium bracket 580 and the second sub-crew hole 565 of the igniter case 563 match each other.

In the above-described configuration of the gas oven rage, a process of separating the igniter 560 from the burner 530 and a process of assembling the igniter 560 with the burner 530 will be described in order with reference to the accompanying drawings.

First, as exemplarily shown in FIG. 4, the fan cover 550 and the burner cover 540 are separated from the heating unit 500, thus exposing the burner 530 to the outside. Here, the fan cover 550 and the burner cover 540 are fixed by fastening screws fastened in the forward and backward directions of the cavity 211 and, thus, an assembler may easily disassemble the fan cover 550 and the burner assembly 540 from the heating unit 500 without interference with a fastening tool and the elements in the cavity 211.

Thereafter, as exemplarily shown in FIG. 7, the medium bracket 680 modularized with the igniter 560 is separated from the fixing bracket 570 by unfastening the main screw S1 simultaneously fastened into the first main screw hole 575 of the fixing bracket 570 and the second main screw hole 585 of the medium bracket 580.

Conventionally, in order to separate the igniter 560 from the burner 530, the burner 530 had to be separated from the support plate 510. However, in the gas oven range 1 in accordance with embodiments of the present invention, an assembler may separate the igniter 560 from the burner 530 for replacement or repair by simply removing the main screw S1 without separation of the burner 530 from the gas oven range 1.

As needed, the assembler may respectively disassemble the medium bracket 580 and the igniter case 563 from the separated igniter 560, and, as needed, the assembler may execute replacement and repair using the modularized set including the medium bracket 580, the igniter case 563 and the igniter 560.

Similarly, the process of assembling the igniter 560 with the burner 530 is performed in reverse order of the process of separating the igniter 560 from the burner 530.

As apparent from the above description, a gas oven range in accordance with one embodiment of the present invention may achieve effects, as follows.

First, an igniter may be easily separated from or assembled with a burner by a simple motion of unfastening or fastening a main screw combined with a medium bracket mediating combination between the burner and the igniter.

Second, the medium bracket is screw-combined with one point of a fixing bracket fixed to the burner and hook-combined with another point of the fixing bracket, which increases fixing force.

Third, the main screw is configured to fasten the fixing bracket and the medium bracket to each other in the forward or backward direction in a cavity and, thus, a fastening tool may be easily received in the cavity under the condition that a burner cover and a fan cover are separated from a burner assembly.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A gas oven range comprising:

a burner attached to a support plate provided at a rear wall of a cavity forming an oven chamber;

a fixing bracket attached to a part of the burner;

an igniter;

an igniter case surrounding the igniter;

a medium bracket, which is attached to the fixing bracket in the forward and backward directions of the cavity relative to the rear wall, attaching the igniter case with the fixing bracket wherein, the medium bracket is hook-combined with one point of the fixing bracket and is screw-combined with another point of the fixing bracket;

wherein the fixing bracket includes:

a first part that is welded to a part of the burner; and a screw fastening plate formed integrally with one side of the first part, the screw fastening plate being bent and screw-attached with the support plate by a main screw fastened to the support plate in the forward and backward directions, wherein the medium bracket is attached with the screw fastening plate of the fixing bracket by the main screw;

wherein the screw fastening plate comprises a first protrusion and a first main screw hole to receive the main screw.

2. The gas oven range of claim 1, wherein the first main screw hole is formed through the screw fastening plate in the forward and backward directions relative to the rear wall of the cavity.

3. The gas oven range of claim 1, wherein:

the first protrusion is formed at one of the upper and lower ends of the screw fastening plate; and the first main screw hole is formed at the other of the upper and lower ends of the screw fastening plate.

4. The gas oven range of claim 1, wherein the first protrusion protrudes from any one of the upper and lower ends of the screw fastening plate and is bent upward or downward.

5. The gas oven range of claim 1, wherein the medium bracket comprises a first hole that is formed at a position of the medium bracket corresponding to the first protrusion in order to receive the first protrusion, and a second main screw hole that is formed at a position of the medium bracket corresponding to the first main screw hole in order to receive the main screw.

6. The gas oven range of claim 1, wherein the medium bracket includes:

a first fixing plate being in surface contact with the screw fastening plate;

a second fixing plate bent forward from the first fixing plate and extending so that the igniter case is combined with the second fixing plate; and a third fixing plate bent leftward or rightward from the second fixing plate so as to support the rear surface of the igniter case.

7. The gas oven range of claim 1, wherein the medium bracket is hook-combined with one point of the igniter case and is screw-combined with another point of the igniter case.

8. The gas oven range of claim 6, wherein the medium bracket further comprises:

a second protrusion formed on the second fixing plate for hook-combination with the igniter case; and a first sub-screw hole formed on the second fixing plate for screw-combination with the igniter case.

9. The gas oven range of claim 8, wherein:

the second protrusion is formed at any one of the upper and lower ends of the second fastening plate; and the first sub-screw hole is formed at the other of the upper and lower ends of the second fastening plate.

10. The gas oven range according to claim 9, wherein the second protrusion protrudes from any one of the upper and lower ends of the second fastening plate and is bent upward or downward.

11. The gas oven range of claim 8, wherein the igniter case comprises:

a second hole formed at a position corresponding to the second protrusion in order to receive the second protrusion; and a second sub-screw hole to receive a sub-screw.

12. The gas oven range of claim 11, wherein the second hole and the second sub-screw hole are formed at a region of the igniter case that extends backward so as to be in surface contact with the second fixing plate.

13. The gas oven range of claim 8, wherein the medium bracket is combined with the igniter case when the medium bracket is separated from the fixing bracket.

* * * * *